US012569719B2

(12) United States Patent
Hu

(10) Patent No.: US 12,569,719 B2
(45) Date of Patent: Mar. 10, 2026

(54) MULTIFUNCTIONAL BALANCED LACING BOARD AND COMPREHENSIVE TRAINING METHOD FOR BALANCED LACING

(71) Applicant: Fang Hu, Zhejiang (CN)

(72) Inventor: Fang Hu, Zhejiang (CN)

( * ) Notice: Subject to any disclaimer, the term of this patent is extended or adjusted under 35 U.S.C. 154(b) by 110 days.

(21) Appl. No.: 18/675,068

(22) Filed: May 27, 2024

(65) Prior Publication Data

US 2025/0288865 A1 Sep. 18, 2025

(30) Foreign Application Priority Data

Mar. 18, 2024 (CN) ..... 202420516674.6

(51) Int. Cl.
*A63B 22/16* (2006.01)

(52) U.S. Cl.
CPC ..... *A63B 22/16* (2013.01); *A63B 2209/08* (2013.01); *A63B 2225/093* (2013.01)

(58) Field of Classification Search
CPC . A63B 21/0004; A63B 21/4034; A63B 22/16; A63B 26/003; A63B 2209/08; A63B 2209/10; A63B 2210/00; A63B 2210/50; A63B 2225/09; A63B 2225/093
See application file for complete search history.

(56) References Cited

U.S. PATENT DOCUMENTS 5,643,164 A * 7/1997 Teff ..... A63B 23/08 482/79
6,916,276 B1 * 7/2005 Robinson ..... A63B 69/0093 482/80
7,625,294 B1 * 12/2009 Isaac ..... A63B 69/3667 473/218
9,700,756 B2 * 7/2017 Franche ..... A63B 71/0054
11,925,836 B2 * 3/2024 Hu ..... A63B 22/16
2010/0167886 A1 * 7/2010 Ko ..... A63B 22/16 482/142
2016/0030800 A1 * 2/2016 McClure ..... A63B 22/16 482/146
2020/0094107 A1 * 3/2020 Mrzlak ..... A63B 22/16
(Continued)

FOREIGN PATENT DOCUMENTS

BR 102013003086 A2 * 12/2014
CN 207871412 U * 9/2018
(Continued)

*Primary Examiner* — Gary D Urbiel Goldner
(74) *Attorney, Agent, or Firm* — Hawaii Patent Services; Nathaniel K. Fedde; Kenton N. Fedde

(57) ABSTRACT

A multifunctional balanced lacing board and a comprehensive training method for balanced lacing are disclosed. The multifunctional balanced lacing board comprises a pedal, wherein a lower end of the pedal is detachably provided with a connector, and a lower end of the connector is detachably connected with a support leg for supporting on a ground surface. The support leg can be detachably connected to the pedal, and a balanced training component or a lacing training component can be selected for the support leg. Different training components can be replaced according to training requirements through a detachable structure. The comprehensive training method for balanced lacing comprises installing the training component on the connector, then installing the connector on the pedal, and stepping on the pedal for use.

13 Claims, 5 Drawing Sheets

(56) References Cited

U.S. PATENT DOCUMENTS

| | | | | |
|---|---|---|---|---|
| 2022/0266090 | A1* | 8/2022 | Mrzlak | A63B 22/16 |
| 2025/0276212 | A1* | 9/2025 | Splichal | A63B 26/003 |

FOREIGN PATENT DOCUMENTS

| | | | | | |
|---|---|---|---|---|---|
| CN | 209828138 | U | * | 12/2019 | A63B 26/003 |
| CN | 209885126 | U | * | 1/2020 | |
| DE | 202012002942 | U1 | * | 6/2012 | A63B 26/003 |
| DE | 202016104107 | U1 | * | 8/2016 | A63B 23/0458 |
| DE | 202022001164 | U1 | * | 6/2022 | A63B 23/1236 |
| ES | 2984135 | A1 | * | 10/2024 | A63B 26/003 |
| FR | 2473306 | A1 | * | 7/1981 | A63B 22/18 |
| KR | 20200001070 | U | * | 5/2020 | A63B 21/4033 |
| KR | 20200143103 | A | * | 12/2020 | A63B 22/16 |
| KR | 20230002245 | U | * | 11/2023 | A63B 22/16 |
| TW | M554364 | U | * | 1/2018 | |

* cited by examiner

MULTIFUNCTIONAL BALANCED LACING BOARD AND COMPREHENSIVE TRAINING METHOD FOR BALANCED LACING

CROSS-REFERENCE TO RELATED APPLICATIONS

This application claims the priority of China Patent Application No. 202420516674.6 filed on Mar. 18, 2024, entitled "Adjustable Lacing Board", and the entire contents of the above application, including the amendments therein, are all incorporated herein by reference.

TECHNICAL FIELD

The present invention relates to the technical field of health care equipment, in particular to a multifunctional balanced lacing board and a comprehensive training method for balanced lacing.

BACKGROUND

With the development of society, people are constantly pursuing better living conditions and better physical condition, while sedentary or bedridden people are prone to venous thrombosis and other problems due to lack of exercise in their lower limbs. The training of balance ability, Ankle pump exercise and stretching exercise can help people to have a better physical foundation for exercise, contribute to various sports and daily activities, and have different degrees of help and conditioning for people of all ages.

At present, there are also many products on the market that can be used for lacing training. When they are used, the angle of the pedal panel can be adjusted. After a certain angle is fixed, the user's feet are placed on the panel for lacing exercise, for example U.S. Pat. Nos. 10,549,142 and 9,364,382 and US20140100086A1.

However, the lacing board disclosed above only has simple lacing angle switching, and the functionality is single in the actual use process, and the user's support legs can't be lacing in different degrees at the same time. In addition, after long-term lacing training, the user's support legs and ankles are prone to discomfort, which may seriously lead to muscle strain. In the prior art, it is also proposed to use the balancing plate with lacing board for training. However, the general balance training products use the combination of cylindrical drum and flat plate for balance training, and the training difficulty is only one difficulty. For people with different balance abilities, the same balance board cannot be used. In the training process, more and different balance boards and lacing boards need to be prepared according to the training requirements, which to some extent increases the equipment cost and affects the management work because of the single function of the training board.

Although many flexible lacing boards and balance boards have been put forward in the prior art, users always hope to provide newer and more versatile training boards with different training difficulty adjustment functions without increasing the equipment cost.

SUMMARY

The present invention provides an adjustable lacing board, which includes a pedal, wherein a connector is detachably arranged at a lower end of the pedal, and a support leg for supporting on the ground is detachably connected at a lower end of the connector, and the connector detachably connects the support leg to the pedal;

the support leg is a quadrilateral plate, one side of the quadrilateral plate is provided with a first hypotenuse, and aside adjacent to the first hypotenuse is provided with a second hypotenuse, and a slope of the first hypotenuse is smaller than that of the second hypotenuse; an opposite side of the first hypotenuse and an opposite side of the second hypotenuse can be detachably connected with the connector;

when a height of the pedal from the ground need to be adjusted, a connection between the opposite side of the first hypotenuse and the connector is detached, and the opposite side of the second hypotenuse is connected with the connector.

At the same time, the present invention provides an adjustable balance board, which includes a pedal, wherein a connector is detachably arranged at a lower end of the pedal, and a support leg for supporting on the ground is detachably connected at a lower end of the connector, and the connector detachably connects the support leg to the pedal;

the support legs is an arched plate, the arched plate has a rectangular mounting plane and is semicircular with the mounting plane as a bottom edge; the arched plate is arranged at a bottom of the pedal, and when the arched plate is detachably connected with the connector by the mounting plane, the mounting plane is kept parallel to a bottom surface of the pedal.

The present invention further provides a comprehensive training method for balanced lacing, comprising:

providing an apparatus, which comprises a pedal, wherein a connector is detachably arranged at a lower end of the pedal, and a support leg for supporting on the ground is detachably connected at a lower end of the connector, and the connector detachably connects the support leg to the pedal;

the method comprises the following steps:

installing the quadrilateral plate on the connector, and then installing the connector on the pedal;

stepping on the pedal and using a lacing training component to support on the ground to carry out a lacing training;

installing the quadrilateral plate with edges changed;

stepping on the pedal, and using the quadrilateral plate to support on the ground to carry out another slope lacing training;

removing the quadrilateral plate from the connector and installing the arched plate;

stepping on the pedal and using the arched plate to support on the ground to carry out a balance training installing the arched plate to the other jack;

stepping on the pedal and using the arched plate to support on the ground to carry out another difficulty balance training.

BRIEF DESCRIPTION OF DRAWINGS

In order to explain the technical scheme of this application more clearly, the drawings needed in the implementation will be briefly introduced below. Obviously, the drawings described below are only some implementations of this application. For those skilled in the art, other drawings can be obtained according to these drawings without creative work.

In the figures

1) Pedal; 2) Connector; 3) Jack; 4) Balance training component; 5) Bracing training component; 6) Anti-collision pad; 7) Guide rail; 21) insertion block; 22) Magnetic attraction part; 23) Connecting groove; 24) Second connecting through hole; 25) Connecting bolt; 26) Connecting plate part; 27) Connecting arc part; 31) Counter bore; 32) Extension hole; 33) Magnetic attraction member; 41) Arched plate; 42) Arched plate pin hole; 43) Mounting plane; 51) Tetrahedral plate; 52) First hypotenuse; 53) Second hypotenuse; 54) First connecting hole; 71) Top post; 72) Elastic member; 73) Stressed inclined plane; 74) Guide block; A) Center line.

DESCRIPTION OF EMBODIMENTS

In the following, the technical scheme in the embodiment of the application will be clearly and completely described with reference to the drawings in the embodiment of the application. Obviously, the described embodiment is only a part of the embodiment of the application, but not the whole embodiment. Based on the embodiments in this application, all other embodiments obtained by those skilled in the art without creative labor belong to the protection scope of this application.

Reference to "an example" or "an embodiment" herein means that a particular feature, structure or characteristic described in connection with an embodiment or an embodiment can be included in at least one embodiment of this application. The appearance of this phrase in various places in the specification does not necessarily refer to the same embodiment, nor is it an independent or alternative embodiment mutually exclusive with other embodiments. It is understood explicitly and implicitly by those skilled in the art that the embodiments described herein can be combined with other embodiments.

In this specification, for the sake of convenience, words and expressions indicating orientation or positional relationship such as "middle", "upper", "lower", "front", "rear", "vertical", "horizontal", "top", "inner" and "outer" are used to illustrate the positional relationship of constituent elements with reference to the attached drawings, only for the convenience of description. The positional relationship of the constituent elements is appropriately changed according to the direction of the described constituent elements. Therefore, it is not limited to the words and expressions described in the specification, and can be replaced appropriately according to the situation.

Example 1

Figure 1:
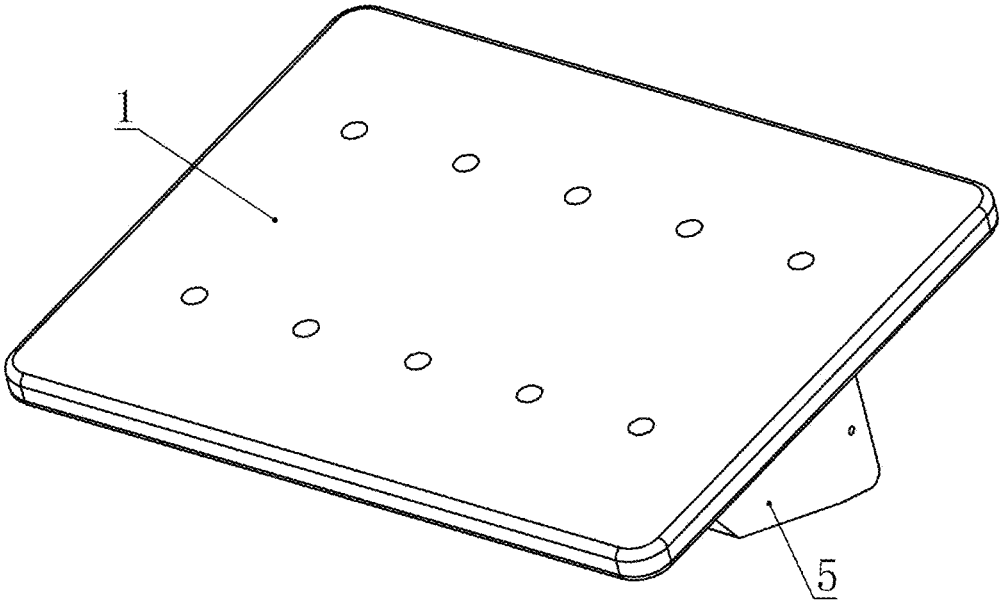
FIG. 1 is a schematic structural view of a balanced lacing board when a quadrilateral plate is installed.
Figure 3:
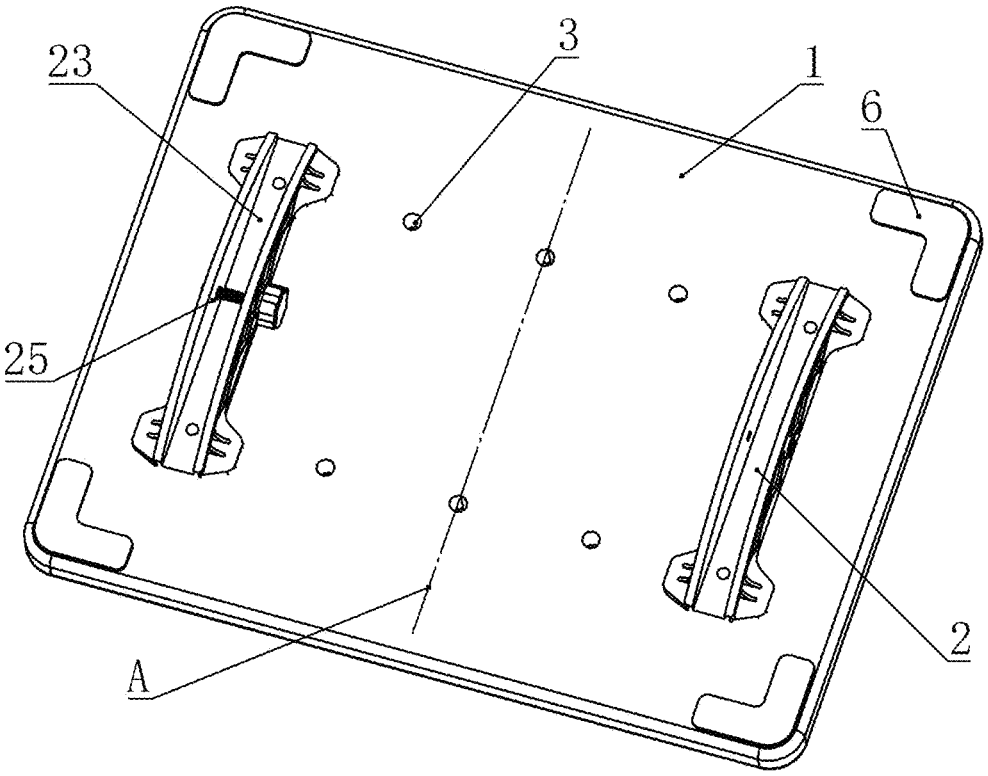
FIG. 3 is a schematic diagram of the bottom structure of the balance lacing board.

Referring to FIGS. 1 and 3, the present application provides an adjustable lacing board, which includes a treadle plate 1, wherein the lower end of the treadle plate 1 is detachably provided with a connector 2, and the lower end of the connector 2 is detachably connected with a support leg for supporting on the ground, and the support leg comprises a balance training component 4 and a lacing training component 5, and the connector 2 detachably connects the support leg to the treadle plate 1; in some embodiments (not shown in the figure), the upper surface of the pedal 1 is provided with an anti-skid design, such as etching anti-skid lines and adding anti-skid materials, to ensure that users will not slip when using, and the upper surface of the pedal 1 can be provided with pedal grooves to optimize ergonomic design; the shape of the pedal 1 can be designed into different shapes, such as arc, square or ellipse, so as to adapt to different exercise mode. As shown in FIG. 3, anti-collision pads 6 are arranged at the four corners of the bottom surface of the pedal 1, which can provide protection when the pedal 1 touches or hits the ground, and the anti-collision pads 6 can be fixed on the bottom surface of the pedal 1 with an adhesive.

Figure 7:
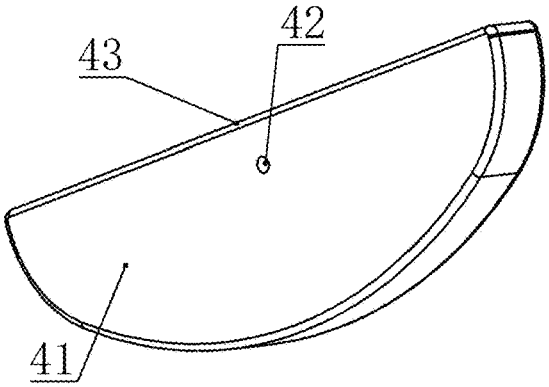
FIG. 7 is a schematic diagram of the arched plate structure.

As shown in FIG. 7, the support leg of this embodiment is a quadrilateral plate, and one side of the quadrilateral plate is provided with a first hypotenuse 52, and the side adjacent to the first hypotenuse 52 is provided with a second hypotenuse 53, and the slope of the first hypotenuse 52 is smaller than that of the second hypotenuse 53; the opposite side of the first hypotenuse 52 and the opposite side of the second hypotenuse 53 can be detachably connected with the connector 2.

When it is necessary to adjust the height of the pedal 1 from the ground, the connection between the opposite side of the first hypotenuse 52 and the connector 2 is disconnected, and the opposite side of the second hypotenuse 53 is connected with the connector 2.

Figure 4:
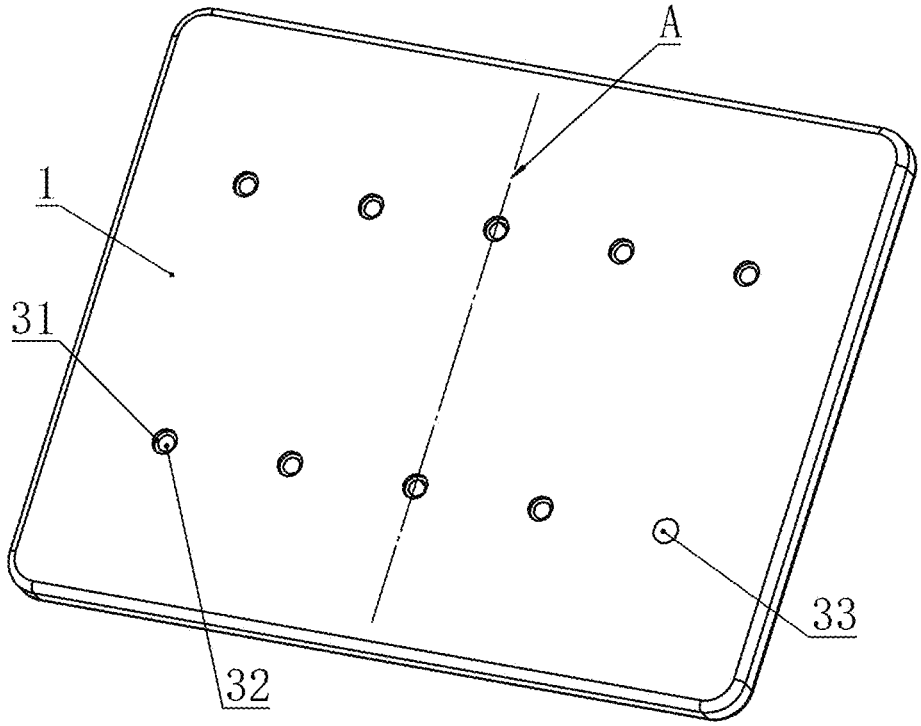
FIG. 4 is a schematic diagram of the top surface structure of the balance lacing board.
Figure 5:
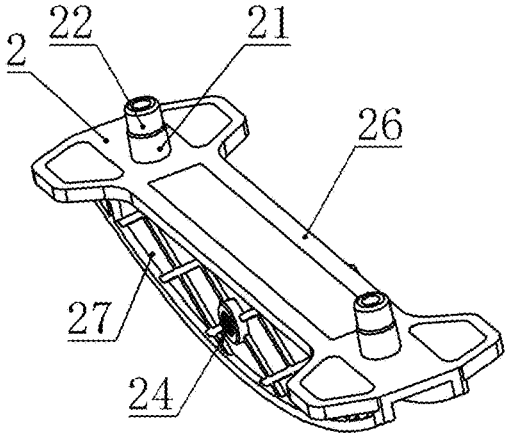
FIG. 5 is a schematic diagram of the connector structure.

Specifically, in this embodiment, as shown in FIGS. 3 to 5, the pedal 1 is a cuboid plate, and all four corners of the pedal 1 are provided with rounded corners. The connector 2 is detachably arranged below the pedal 1, and a support leg is detachably connected below the connector 2. The support leg is a cuboid plate, and two adjacent edges of the support leg are respectively provided with a first hypotenuse 52 and a second hypotenuse 53, with the first hypotenuse 52 being arranged on the long side and the second hypotenuse 53 being arranged on the short side, and the slope of the first hypotenuse 52 being smaller than that of the second hypotenuse 53. When the other long side is connected with the connector 2, the first hypotenuse 52 is supported on the ground, and the pedal 1 is obliquely placed on the ground, which is convenient for users to do lacing exercises. When it is necessary to change the height of the pedal 1 from the ground, the connection between the feet and the connector 2 is cancelled, and the other short side is connected with the connector 2, so that the second hypotenuse 53 is supported on the ground and the pedal 1 is obliquely placed on the ground.

As shown in FIG. 5, in some embodiments, the connector 2 includes a rectangular connecting plate part 26 and a connecting arc part 27 with an arc vertical section, wherein the connecting plate part 26 is detachably connected with the pedal 1, and the connecting arc part 27 is detachably connected with the support leg. In some embodiments (not shown in the figure), the jack 3 can be designed as a threaded hole or a reduced-diameter hole opened at the bottom of the pedal 1, and the connection is realized by screwing the insertion block into the threaded hole or inserting it into the reduced-diameter hole. The threaded connection mode is reliable, and the plug-in connection mode is more convenient to disassemble.

In some embodiments, the connecting arc part 27 is provided with a connecting groove 23, and the support leg is inserted into the connecting groove 23 and is in interference fit with the connecting groove 23.

In some embodiments, the end of the connecting plate part 26 far away from the connecting arc part 27 is provided with an insertion block 21, and the pedal 1 is provided with a jack 3, and the insertion block 21 can be inserted into the jack 3 to connect the connector 2 with the pedal 1. In some embodiments (not shown in the figure), the jack 3 can be designed as a threaded hole or a reduced-diameter hole opened at the bottom of the pedal 1, and the connection is realized by screwing the insertion block into the threaded hole or inserting it into the reduced-diameter hole. The threaded connection mode is reliable, and the plug-in connection mode is more convenient to disassemble.

Specifically, in this embodiment, the upper end of the connecting part of the cuboid is provided with a sealing strip, which can seal the connecting part and the lower end face of the pedal 1 and reduce the friction between them, so as to prevent the pedal 1 from being worn and improve the service life of the pedal 1; the connecting arc part 27 is provided with a connecting groove 23; the support leg is first inserted into the connecting groove 23, and then the two are connected by a fixing structure; the upper end of the connecting plate part 26 is provided with an insertion block 21, which is inserted into the jack 3 to preliminarily connect the two. When the insertion block 21 is inserted into the jack 3, the magnetic attraction part 22 is attracted to the magnetic attraction member 33 to fix the insertion block 21 in the jack 3, which makes the disassembling more convenient. In some embodiments, the jack 3 includes an extension hole 32 on the bottom surface of the pedal 1 and a counter bore 31 on the top surface of the pedal 1. The counter bore 31 is communicated with the extension hole 32, and a magnetic attraction member 33 is buried in the counter bore 31. The top of the insertion block 21 is provided with a magnetic attraction part 22 magnetically attracted to the magnetic attraction member 33.

Figure 6:
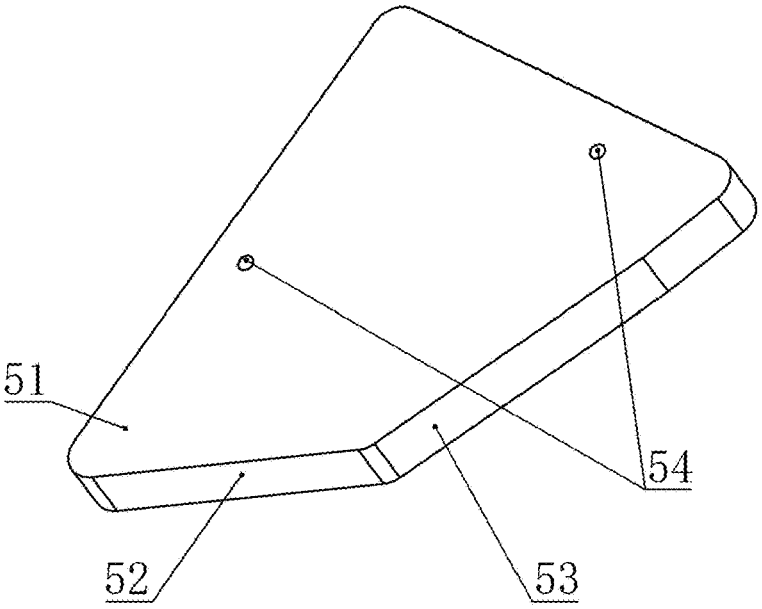
FIG. 6 is a schematic structural diagram of a quadrilateral plate.

As shown in FIG. 6, in some embodiments, the support leg is provided with a first connecting hole 54, the connecting arc part 27 is provided with a second connecting through hole 24, and the connecting bolt 25 is arranged in the first connecting hole 54; the connecting bolt 25 penetrates through the second connecting through hole 24 and the first connecting hole 54 respectively to connect the support leg with the connector 2. This connection mode is suitable for the situation that frequent disassembly is needed, so that a quick replacement system of the training components of the connector 2 can be realized, and users can easily replace different training components, so that the functional conversion of the balance lacing board is more functional and more flexible.

In some embodiments, chamfers 34 are provided at the four corners of the support leg.

In some embodiments, the pedal 1 is arranged in a cuboid shape, and the pedal 1 is provided with evenly arranged jacks 3 in two rows and multiple columns, and the connecting plate part 26 is provided with two insertion blocks 21; by arranging evenly arranged jacks 3 in two rows and multiple columns, different supporting effects are formed at the bottom of the pedal 1, different training modes are realized, and the pedal is more multifunctional. The distance between two adjacent jacks 3 in a same row or two spaced jacks is the same as that between two adjacent jacks 3 in a same row and is equal to a distance between two insertion blocks 21.

As shown in FIG. 3 and FIG. 4, in some embodiments, the midline of the lateral length of the pedal 1 is taken as the symmetry axis of the axisymmetric shape, so as to ensure the balance between the two sides in use, while two of several jacks 3 are arranged on the midline A of the lateral length of the pedal 1, and the rest jacks 3 are arranged left and right outside the midline A and symmetrically. By arranging the jacks 3 with different distances from the center line A, different supporting effects are formed at the bottom of the pedal 1, different training modes are realized, and the pedal is more multifunctional.

As shown in FIG. 4 and FIG. 5, a magnetic attraction member 33 is arranged in each jack 3, and a magnetic attraction part 22 is arranged in the insertion block 21 far from the connecting plate part 26, and the magnetic attraction member 33 cooperates with the magnetic attraction part 22 to connect the pedal 1 with the connector 2. In another embodiment (not shown in the figure), a magnetic attraction part is arranged in each of the jacks 3, and a magnetic attraction member is arranged on the insertion block 21 far away from the connecting plate part 26, and the magnetic attraction member is matched with the magnetic attraction part to connect the pedal 1 with the connector 2 as shown in FIG. 6.

Specifically, in this embodiment, as shown in FIG. 6, two first communication holes 54 are provided on the support leg, and the two first communication holes 54 are respectively provided at the positions where the long side and the short side of the first inclined side 31 and the second inclined side 32 are not provided, and when the support leg is inserted into the connection groove 23, the first communication hole 54 and the second connection through hole 24 are opposite, so that the connecting bolt 25 passes through the first communication hole 54 and the second connection through hole 24 to further connect the support leg with the connector 2, so that the support leg cannot be disconnected from the connector 2 and the position cannot move back and forth, so that the connection is more stable and the disassembly is more convenient. Not only can the lacing exercise be assisted, but also the height can be adjusted according to different use conditions, so that the lacing exercise can be better assisted, and the lacing exercise is more convenient to use, simple in structure, convenient to assemble, carry, store and operate.

Example 2

Figure 2:
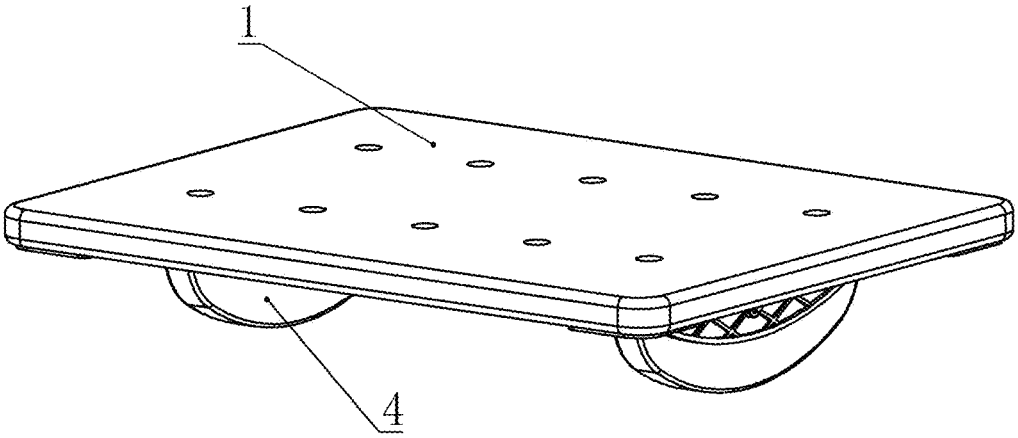
FIG. 2 is a schematic structural view of the balanced lacing board when the arched plate is installed.

Referring to FIGS. 2 and 3, an adjustable balance board comprises a pedal, wherein the lower end of the pedal 1 is detachably provided with a connector 2, and the lower end of the connector 2 is detachably connected with a support leg for supporting on the ground, and the connector 2 detachably connects the support leg to the pedal 1; in some embodiments (not shown in the figure), the upper surface of the pedal 1 is provided with an anti-skid design, such as etching anti-skid lines and adding anti-skid materials, to ensure that users will not slip when using, and the upper surface of the pedal 1 can be provided with pedal grooves to optimize ergonomic design; the shape of that pedal 1 can be designed into different shapes, such as arc, square or ellipse, so as to adapt to different exercise mode. As shown in FIG. 3, anti-collision pads 6 are arranged at the four corners of the bottom surface of the pedal 1, which can provide protection when the pedal 1 touches or hits the ground, and the anti-collision pads 6 can be fixed on the bottom surface of the pedal 1 with an adhesive.

In this embodiment, as shown in FIG. 7, the support leg is arranged in a semicircle with a rectangular vertical section, and the user can stand on the pedal 1 to keep its balance by himself. Specifically, the support leg is an arched plate 41, which has a rectangular mounting plane 43 and is semicircular with the mounting plane 43 as a base. The arched plate 41 is arranged at the bottom of the pedal 1, and when the arched plate 41 is detachably connected with the connector 2, the mounting plane 43 is parallel to the bottom of the pedal 1. Besides the arched plate 41, in some embodiments (not shown in the figure), the support leg can be designed for other shapes of balance boards, such as spherical, hemispherical or wavy. When users want to do balance training, they can choose different balance training components 4 to be installed on the connector 2 of the pedal 1, and the connector 2 can also be installed in different jacks 3 as needed to change the training difficulty. In some embodiments (not shown in the figure), the pedal 1 is directly supported on the ground by the connecting arc part 27 of the connector 2 without a support leg, and the user shakes his body according to the support of the arc surface on the ground to keep balance.

As shown in FIG. 5, in some embodiments, the connector 2 includes a rectangular connecting plate part 26 and a connecting arc part 27 with an arc vertical section, wherein the connecting plate part 26 is detachably connected with the pedal 1, and the connecting arc part 27 is detachably connected with the support leg. In some embodiments (not shown in the figure), the jack 3 can be designed as a threaded hole or a reduced-diameter hole opened at the bottom of the pedal 1, and the connection is realized by screwing the insertion block into the threaded hole or inserting it into the reduced-diameter hole. The threaded connection mode is reliable, and the plug-in connection mode is more convenient to disassemble.

In some embodiments, the connecting arc part 27 is provided with a connecting groove 23, and the support leg is inserted into the connecting groove 23 and is in interference fit with the connecting groove 23.

In some embodiments, the end of the connecting plate part 26 far away from the connecting arc part 27 is provided with an insertion block 21, and the pedal 1 is provided with a jack 3; the insertion block 21 can be inserted into the jack 3 to connect the connector 2 with the pedal 1. In some embodiments (not shown in the figure), the jack 3 can be designed as a threaded hole or a reduced-diameter hole opened at the bottom of the pedal 1, and the connection is realized by screwing the insertion block into the threaded hole or inserting it into the reduced-diameter hole. The threaded connection mode is reliable, and the plug-in connection mode is more convenient to disassemble.

Specifically, in this embodiment, as shown in FIGS. 3 to 5, the upper end of the connecting part of the cuboid is provided with a sealing strip, which can seal the connecting part and the lower end face of the pedal 1 and reduce the friction between them, so as to prevent the pedal 1 from being worn and improve the service life of the pedal 1; the connecting arc part 27 is provided with a connecting groove 23, and the support legs are first inserted in to the connecting groove 23, and then the two are connected by a fixing structure; the upper end of the connecting plate part 26 is provided with an insertion block 21, which is inserted into the jack 3 to preliminarily connect the two. When the insertion block 21 is inserted into the jack 3, the magnetic attraction part 22 is attracted to the magnetic attraction member 33 to fix the insertion block 21 in the jack 3, which makes the disassembly more convenient. In some embodiments, the jack 3 includes an extension hole 32 on the bottom surface of the pedal 1 and a counter bore 31 on the top surface of the pedal 1. The counter bore 31 is communicated with the extension hole 32, and a magnetic attraction member 33 is buried in the counter bore 31. The top of the insertion block 21 is provided with a magnetic attraction part 22 magnetically attracted to the magnetic attraction member 33.

As shown in FIG. 7, in some embodiments, the support leg is provided with a first connecting hole 54, the connecting arc part 27 is provided with a second connecting through hole 24, and the connecting bolt 25 is arranged in the first connecting hole 54, and the connecting bolt 25 penetrates through the second connecting through hole 24 and the first connecting hole 54 respectively to connect the support leg with the connector 2. This connection mode is suitable for the situation that frequent disassembly is needed, so that a quick replacement system of the training components of the connector 2 can be realized, and users can easily replace different training components, so that the functional conversion of the balance lacing board is more functional and more flexible.

In some embodiments, the pedal 1 is arranged in a cuboid shape, and the pedal 1 is provided with evenly arranged jacks 3 in two rows and multiple columns, and the connecting plate part 26 is provided with two insertion blocks 21; By arranging evenly arranged jacks 3 in two rows and multiple columns, different supporting effects are formed at the bottom of the pedal 1, different training modes are realized, and the pedal is more multifunctional. The distance between two adjacent jacks 3 in a same row or two spaced jacks is the same as that between two adjacent jacks 3 in a same row and is equal to a distance between two insertion blocks 21.

As shown in FIG. 3 and FIG. 4, in some embodiments, the midline of the lateral length of the pedal 1 is taken as the symmetry axis of the axisymmetric shape, so as to ensure the balance between the two sides in use, while two of several jacks 3 are arranged on the midline A of the lateral length of the pedal 1, and the rest jacks 3 are arranged left and right outside the midline A and symmetrically. By arranging the jacks 3 with different distances from the center line A, different supporting effects are formed at the bottom of the pedal 1, and different training modes are realized, which is more multifunctional.

A magnetic attraction member 33 is arranged in each jack 3, and a magnetic attraction part 22 is arranged in the insertion block 21 far away from the connecting plate part 26. The magnetic attraction member 33 cooperates with the magnetic attraction part 22 to connect the pedal 1 with the connector 2. In another embodiment (not shown in the figure), a magnetic attraction part is arranged in each of the jacks 3, and a magnetic attraction member is arranged on the insertion block 21 far from the connecting plate part 26, and the magnetic attraction member cooperates with the magnetic attraction part to connect the pedal 1 with the connector 2.

Specifically, in this embodiment, as shown in FIG. 7, the arched plate 41 is provided with a first connecting hole 54 through which the connecting bolt 25 passes. The first connecting hole 54 is in the form of the arched plate pin hole 42 in this embodiment, and when the arched plate 41 is inserted into the connecting groove 23, the arched plate pin hole 42 and the second connecting through hole 24 are opposite to each other, so that the connecting bolt 25 passes through the arched plate pin hole 42 and the second connecting through hole 24 to further connect the support leg with the connector 2, so that the support legs cannot be disconnected from the connector 2 and the position cannot move back and forth, so that the connection is more stable and the disassembly is more convenient. The connector 2 can also be installed in different jacks 3 according to needs, so as to change the training difficulty, not only to assist the balance exercise, but also to better assist the balance exercises according to different use conditions, which is more convenient to use, simple in structure, convenient to assemble, carry, store and operate.

Figure 8:
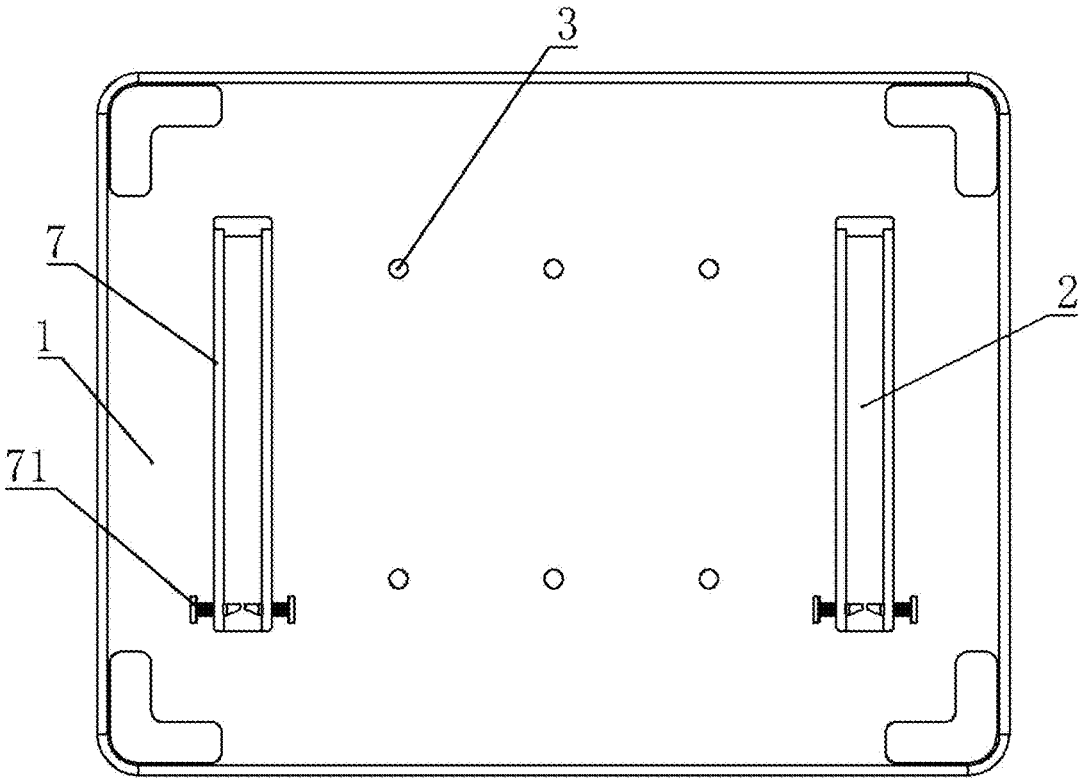
FIG. 8 is a schematic diagram of a pedal structure according to another embodiment of the present invention.
Figure 9:
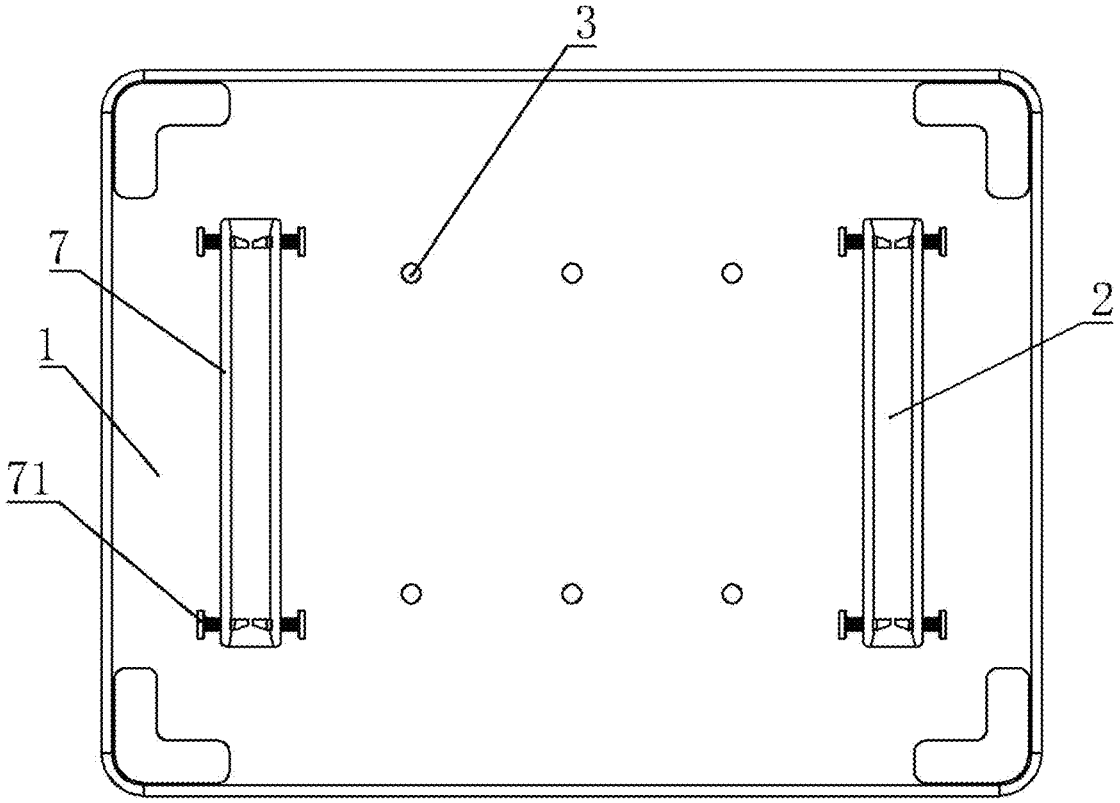
FIG. 9 is another schematic diagram of a pedal according to another embodiment of the present invention.
Figure 12:
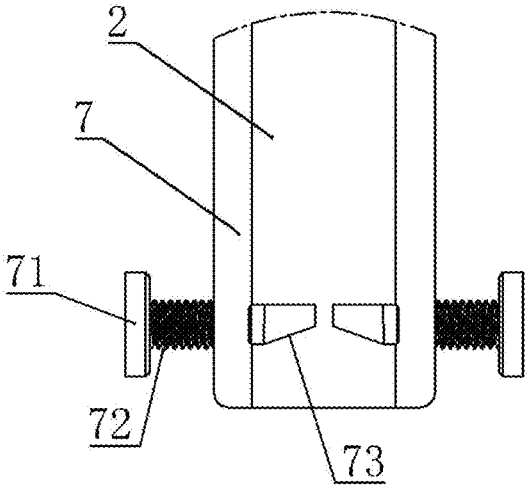
FIG. 12 is a partial enlarged view of a guide rail structure according to another embodiment of the present invention.

In some embodiments, as shown in FIG. 8 and FIG. 9, the connector 2 is provided with a guide rail 7 slidably connected with the support leg, and the connector 2 is provided with a locking member for locking the support leg on the guide rail 7. As shown in FIG. 12, the locking member comprises a telescopic top post 71 arranged on the guide rail 7, and the top post 71 extends out to limit the sliding of the balance training component 4 or the lacing training component 5. An elastic member 72 is connected between the top post 71 and the guide rail 7, and the top post 71 is provided with a stressed inclined plane 73. When the stressed inclined plane 73 is stressed, the top post 71 retracts against the elastic force of the elastic member 72. The top post 71 can be arranged in multiple places in a multiple number according to the end position of the balance training component 4 or the lacing training component 5 in the guide rail 7.

Figure 10:
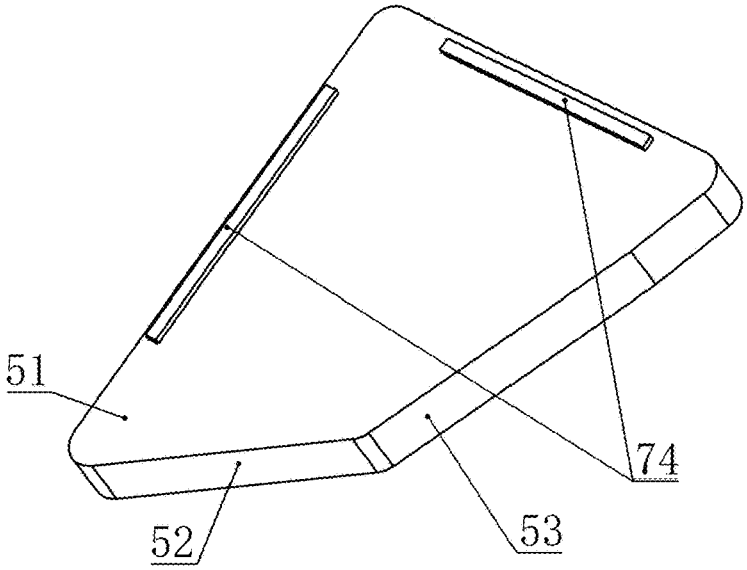
FIG. 10 is a schematic structural diagram of a quadrilateral plate according to another embodiment of the present invention.
Figure 11:
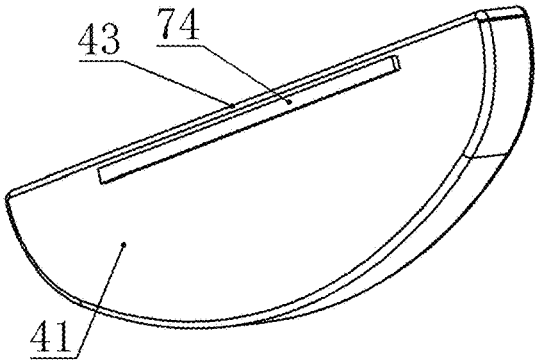
FIG. 11 is a schematic diagram of an arched plate structure according to another embodiment of the present invention.

As shown in FIG. 11, the arched plate 41 may be provided with a guide groove slidably connected with the guide rail 7, or a positioning hole for inserting the top post 71. As shown in FIG. 10, the quadrilateral plate 51 is provided with a plurality of guide blocks 74 which can be slidably connected with the guide rail 7, and the guide blocks 74 are arranged corresponding to the opposite side of each hypotenuse. The quadrilateral plate 51 can be mounted to the bottom of the pedal 1 through any hypotenuse, and the mounting surface of the hypotenuse is parallel to the bottom of the pedal 1. In some embodiments (not shown in the figure), the arched plate 41 and the quadrilateral plate 51 can be provided with guide grooves slidably connected with the guide rail 7, or positioning holes for inserting the top posts 71.

To sum up, the multifunctional balance lacing board provides various installation modes of the connector 2 by arranging the jacks 3 at different positions, and the connector 2 is detachable, so that different training components can be replaced according to training requirements, and different training contents can be possessed; and the training items have different training difficulties through the adjustment function, and at the same time, the equipment storage space can be saved without increasing the equipment cost.

In another embodiment of the present invention, the present invention also provides a comprehensive training method for balanced lacing, including:

providing an apparatus, which comprises a pedal, wherein a connector is detachably arranged at a lower end of said pedal, and a support leg for supporting on the ground is detachably connected at a lower end of said connector, and said connector detachably connects said support leg to said pedal;

the method comprises said following steps:

installing the quadrilateral plate 51 on the connector 2, and then installing the connector 2 on the pedal 1;

stepping on the pedal 1 and using a lacing training component 5 to support on the ground to carry out a lacing training;

installing the quadrilateral plate 51 with edges changed, wherein, the quadrilateral plate 51 can be installed as a quadrilateral plate 51 with different left and right inclinations;

stepping on the pedal 1, and using the quadrilateral plate 51 to support on the ground to carry out another slope lacing training;

removing the quadrilateral plate 51 from the connector 2 and installing the arched plate 41;

stepping on the pedal 1 and using the arched plate 41 to support on the ground to carry out a balance training installing the arched plate 41 to the other jack 3; according to the arrangement of the designed jack 3, the arched plate 41 can also be installed vertically or horizontally, and the user can carry out front-and-back or left-and-right balance training;

stepping on the pedal 1 and using the arched plate 41 to support on the ground to carry out another difficulty balance training.

According to the training method for lacing training and balancing training by using the equipment mentioned above, lacing training and balancing training can be carried out independently or in no particular order, and the inclination or difficulty selection in lacing training and balancing training can also be adjusted according to personal needs, such as single lacing training or balancing training with different difficulties for more than two times, wherein the inclination selection of lacing training can also be selected as lacing trainings with different inclinations on two sides, which can be realized by installing lacing training components 5 with different inclinations on the left and right sides of the equipment, and targeted training can be carried out according to the actual situation of users' legs.

The technical means disclosed in the scheme of the present invention are not limited to the technical means disclosed in the above embodiments, but also include the technical scheme composed of any combination of the above technical features. It should be pointed out that for those skilled in the art, several improvements and embellishments can be made without departing from the principle of the present invention, and these improvements and embellishments are also regarded as the protection scope of the present invention.

What is claimed is:

1. An adjustable lacing board, comprising a pedal, wherein a connector is detachably arranged at a lower end of said pedal, a support leg for supporting on a ground surface is detachably connected at a lower end of said connector, and said connector detachably connects said support leg to said pedal;

wherein said support leg is a quadrilateral plate, one side of said quadrilateral plate is provided with a first hypotenuse, and a side adjacent to said first hypotenuse is provided with a second hypotenuse, a slope of said first hypotenuse is smaller than that of said second hypotenuse, and an opposite side of said first hypotenuse and an opposite side of said second hypotenuse can be detachably connected with said connector;

wherein when a height of said pedal from the ground surface needs to be adjusted, a connection between the opposite side of said first hypotenuse and said connector is detached, and the opposite side of said second hypotenuse is connected with said connector; and wherein said connector comprises a connecting plate part being rectangular and a connecting arc part with an arc vertical section, wherein said connecting plate part is detachably connected with said pedal, and said connecting arc part is detachably connected with said support leg.

2. The adjustable lacing board according to claim 1, wherein said connecting arc part is provided with a connecting groove, and said support leg is inserted into said connecting groove and is in an interference fit with said connecting groove.

3. The adjustable lacing board according to claim 1, wherein a first insertion block is arranged at a first end of two opposing ends of said connecting plate part away from said connecting arc part, a plurality of jacks is arranged on said pedal, and said first insertion block is insertable into a first jack of said plurality of jacks to connect said connector with said pedal.

4. The adjustable lacing board according to claim 3, wherein said pedal is arranged in a cuboid shape, and said plurality of jacks are uniformly arranged in two rows and multiple columns formed on said pedal;

a second insertion block is arranged at a second end of said two opposing ends of said connecting plate part away from said connecting arc part, said first and second insertion blocks being spaced apart by a first distance;

said first insertion block is insertable into said first jack of said plurality of jacks located in a first row of said two rows and in one column of said multiple columns;

said second insertion block is insertable into a second jack of said plurality of jacks located in a second row of said two rows and in said one column; and said first and second jacks are spaced apart across said one column by said first distance.

5. The adjustable lacing board according to claim 4, wherein a magnetic attraction member is arranged in each of said plurality of jacks, and a magnetic attraction part is arranged at a part of each of said first and second insertion blocks away from said connecting plate part; and said magnetic attraction members respectively cooperate with said magnetic attraction parts to connect said pedal with said connector.

6. The adjustable lacing board according to claim 1, wherein said support leg is provided with a first connecting through hole, said connecting arc part is provided with a second connecting through hole, and a connecting bolt is arranged in said first connecting through hole, said connecting bolt penetrates through said second connecting through hole and said first connecting through hole respectively to connect said support leg with said connector.

7. The adjustable lacing board according to claim 1, wherein chamfers are arranged at four corners of said support leg.

8. An adjustable balance board, comprising a pedal, wherein a connector is detachably arranged at a lower end of said pedal, a support leg for supporting on a ground surface is detachably connected at a lower end of said connector, and said connector detachably connects said support leg to said pedal; and said support leg is an arched plate, said arched plate has a mounting plane being rectangular and semicircular with said mounting plane as a bottom edge thereof, said arched plate is arranged at a bottom of said pedal, and when said arched plate is detachably connected with said connector by said mounting plane, said mounting plane is kept parallel to a bottom surface of said pedal; and wherein said connector comprises a connecting plate part being rectangular and a connecting arc part with an arc vertical section, wherein said connecting plate part is detachably connected with said pedal, and said connecting arc part is detachably connected with said support leg.

9. The adjustable balance board according to claim 8, wherein said connecting arc part is provided with a connecting groove, and said support leg is inserted into said connecting groove and is in an interference fit with said connecting groove.

10. The adjustable balance board according to claim 8, wherein a first insertion block is arranged at a first end of two opposing ends of said connecting plate part away from said connecting arc part, a plurality of jacks is arranged on said pedal, and said first insertion block is insertable into a first jack of said plurality of jacks to connect said connector with said pedal.

11. The adjustable balance board according to claim 10, wherein said pedal is arranged in a cuboid shape, and said plurality of jacks are uniformly arranged in two rows and multiple columns formed on said pedal;

a second insertion block is arranged at a second end of said two opposing ends of said connecting plate part away from said connecting arc part, said first and second insertion blocks being spaced apart by a first distance;

said first insertion block is insertable into said first jack of said plurality of jacks located in a first row of said two rows and in one column of said multiple columns;

said second insertion block is insertable into a second jack of said plurality of jacks located in a second row of said two rows and in said one column; and said first and second jacks are spaced apart across said one column by said first distance.

12. The adjustable lacing board according to claim 11, wherein a magnetic attraction member is arranged in each of said plurality of jacks, and a magnetic attraction part is arranged at a part of each of said first and second insertion blocks away from said connecting plate part; and said magnetic attraction members respectively cooperate with said magnetic attraction parts to connect said pedal with said connector.

13. The adjustable balance board according to claim 8, wherein said support leg is provided with a first connecting through hole, said connecting arc part is provided with a second connecting through hole, and a connecting bolt is arranged in said first connecting through hole, said connecting bolt penetrates through said second connecting through hole and said first connecting through hole respectively to connect said support leg with said connector.

* * * * *